US007677560B2

(12) United States Patent
Häusler

(10) Patent No.: US 7,677,560 B2
(45) Date of Patent: Mar. 16, 2010

(54) APPARATUS FOR DEFLECTING SHEET MATERIAL

(75) Inventor: August Häusler, Wolfratshausen (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 11/989,766

(22) PCT Filed: Aug. 7, 2006

(86) PCT No.: PCT/EP2006/007804

§ 371 (c)(1),
(2), (4) Date: May 1, 2008

(87) PCT Pub. No.: WO2007/017233

PCT Pub. Date: Feb. 15, 2007

(65) Prior Publication Data

US 2008/0284088 A1 Nov. 20, 2008

(30) Foreign Application Priority Data

Aug. 8, 2005 (DE) ..... 10 2005 037 299

(51) Int. Cl.
*B65H 5/12* (2006.01)

(52) U.S. Cl. ..... 271/269; 271/184; 271/225; 271/271; 271/902; 198/723; 198/479.1

(58) Field of Classification Search ..... 271/225, 271/271, 184, 269, 902; 198/722, 723, 479.1
See application file for complete search history.

(56) References Cited

U.S. PATENT DOCUMENTS 4,963,896 A * 10/1990 Murasaki et al. ..... 346/134
5,158,277 A * 10/1992 Reist ..... 271/266
6,098,978 A 8/2000 Bielefeld et al.
2005/0029168 A1 2/2005 Jones et al.

FOREIGN PATENT DOCUMENTS

DE 196 32 224 A1 2/1998
WO WO 97/33823 9/1997
WO WO 2004054905 A1 * 7/2004
WO WO 2005/068333 A2 7/2005

* cited by examiner

*Primary Examiner*—Patrick H Mackey
*Assistant Examiner*—Gerald W McClain
(74) *Attorney, Agent, or Firm*—Bacon & Thomas, PLLC

(57) ABSTRACT

An apparatus for deflecting sheet material from a first transport direction to a second transport direction while maintaining the orientation of the sheet material comprises a deflecting area (5) with a sheet-material supply zone (5*a*) and a sheet-material removal zone (5*b*), as well as at least one slider (11) with slider elements (12), which engages on the trailing edge of the sheet material to be deflected. By moving the slider from the sheet-material supply zone to the sheet-material removal zone around a rotation axis (13) the sheet material is deflected by the desired deflection angle. The sheet-material transport path preferably has two steps and the rotation axis (13) of the sliders (11) is preferably arranged in such a fashion that the slider elements (12) substantially only engage with the sheet-material transport path in the deflecting area (5) and emerge from the sheet-material transport path both upstream of the sheet-material supply zone (5*a*) and downstream of the sheet-material removal zone (5*b*).

23 Claims, 6 Drawing Sheets

APPARATUS FOR DEFLECTING SHEET MATERIAL

FIELD OF ART

The invention relates to an apparatus for deflecting flat, rectangular sheet material, in particular of sheet-shaped documents of value such as e.g. bank notes, from a first sheet-material transport path with a first transport direction to a second sheet-material transport path with a transport direction that differs from the first transport direction, in particular for changing the transport direction by 90° or by 180°. The invention furthermore relates to an apparatus for processing sheet-shaped documents of value, in particular bank notes, with such a deflecting device between a first and a second transport path with different transport directions.

BACKGROUND

Deflecting devices in which sheet material is deflected by 90° or 180° are for example used in bank note processing apparatus. However, conventional deflecting devices are either not suitable for deflecting a continuous flow of bank notes in such a fashion at a high throughput speed, or at least require a comparatively large space and/or have a comparatively elaborate structure.

From US-2005/0029168 A1 for example a bank note processing apparatus consisting of several modules is known, in which the deflecting device according to the invention described below can also be used advantageously. This bank note processing apparatus is configured as a desktop device and serves to single the bank notes of a stack of bank notes placed in an input pocket by an operator, to check the singled bank notes in regard of characteristic features by means of suitable measuring and analysis devices, to sort the checked bank notes in accordance with the respective check result, and to stack them in accordance with the sorting result in a predetermined output pocket by means of a spiral slot stacker. The output pockets are arranged partly side by side and partly on top of each other in such a fashion that all output pockets are accessible to the operator as easily as possible. Within the modules the bank notes are generally transported in transverse orientation.

It is a disadvantage of this bank note processing apparatus that a very voluminous transport path, formed by guide plates and twisted conveyor belts, is provided to turn the bank notes in such a fashion that they can be further transported sideways to the adjacent modules in transverse orientation. Therein the bank notes are first turned around their transport axis by 90° by means of the twisted conveyor belts, subsequently the bank notes are deflected by 90° around an axis oriented transversely to the transport path, and transferred to the adjacent module in this orientation. There the bank notes are returned to their original orientation by firstly deflecting them by 90° again and subsequently again turning them by 90° around the transport axis by means of the twisted conveyor belts. This method for transferring the bank notes from one module to an adjacent module while maintaining the orientation of the sheet material relative to the transport direction is very elaborate in regard of space requirement and structural configuration, however at least it allows deflecting a continuous flow of bank notes at a high throughput speed.

From WO97/33823 an apparatus for changing the transport direction of single sheets is known, which could probably be used in the bank note processing apparatus known from US-2005/0029168 A1 to deflect the bank notes by 90° to the adjacent modules. Bank notes transported in transverse orientation would then, after deflection by 90°, be passed on to the adjacent module in longitudinal orientation, and there could again be deflected by 90° in a corresponding fashion, thereby enabling their further processing in transverse orientation. However, this apparatus has the disadvantage that the deflecting area has to be cleared first before the subsequent bank note can enter the deflecting area. With this apparatus it is therefore impossible to deflect a continuous flow of bank notes at a high throughput speed.

DE 196 32 224 A1 also describes an apparatus for deflecting sheet material. There it is proposed to do without deflecting rollers in the deflecting area and to extend conveyor belts of the supplying and the removing transport paths respectively beyond the deflecting area in such a fashion that the bank note is removed from the deflecting area by means of the conveyor belt of the removing transport path. By means of a lifting-roller system the conveyor belt of the removing transport path is pressed against the removal plane of the deflecting area every time a bank note has been supplied to the removal plane. In order to increase the throughput while avoiding the danger of collision of successive bank notes described above, a special embodiment provides to use a switch for supplying the successive bank notes alternately to a first or a second removal plane, so that the subsequent sheet can already be supplied to the second removal plane before the preceding sheet has been removed entirely from the first removal plane and passed on. Correspondingly two removal systems are required, one for each removal plane. It is true that in this fashion a continuous flow of bank notes can be deflected at a high throughput speed. However, providing several removal systems requires a high constructive effort.

SUMMARY

It is therefore the object of the present invention to propose an apparatus for deflecting sheet material, such as bank notes or other sheet-shaped documents of value, between a first and a second sheet-material transport path with different transport directions, which permits a continuous flow of bank notes at a high throughput speed and at a relatively small constructive effort.

The deflecting device according to the invention is among other things characterized in that the orientation of the sheet material relative to the transport direction is not changed during the deflection of the sheet material. Rather, sheet material supplied in transverse orientation by the first transport path is deflected in this orientation and passed on to the subsequent, second transport path. For this purpose on the one hand a support plate defining a transport path for the sheet material to be transported and comprising the deflecting area with a sheet-material supply zone and a sheet-material removal zone, and on the other hand at least one slider serving to engage on a trailing edge of the sheet material supplied in the sheet-material supply zone, i.e. to push the sheet material from behind, are provided. The slider is mounted in such a fashion that by moving the slider the sheet material engaged on in the sheet-material supply zone is pushed along the transport path from the sheet-material supply zone to the sheet-material removal zone, while maintaining the orientation of the sheet material relative to the pushing direction.

Thereby it is possible at a relatively small technical effort to deflect a continuous flow of bank notes by a desired angle along a given transport path while maintaining the orientation of the sheet material.

The movement of the slider can be realized particularly easily if the slider is disposed rotatably around a rotation axis. The sheet material is then deflected along a circular path.

Having pushed the sheet material from the sheet-material supply zone to the sheet-material removal zone, the slider is again moved to the sheet-material supply zone to engage on the subsequent sheet material in a corresponding fashion and to move it to the sheet-material removal zone. Preferably the slider is not returned for this purpose, but rotates continuously in one direction around its rotation axis. The transport speed and the timing of the supplied bank notes can be adjusted to the rotation speed of the slider in such a fashion that a jolt-free transfer of the sheet material from the transport path to the sheet-material supply zone is ensured.

To increase the throughput it is furthermore advantageous to provide at least two sliders disposed symmetrically in relation to a movement center of the slider, thus in particular in relation to the aforementioned rotation axis of the slider. In the case of a deflection by 180° it is for example expedient to provide at least two sliders, so that the second slider collects subsequent sheet material in the sheet-material supply zone, while the first slider transfers already deflected sheet material from the sheet-material removal zone to a downstream transport path. Depending on the spacing between the transported bank notes also three or four such sliders can be provided.

The slider can for example have slider elements implemented in a fingerlike shape, which engage in the sheet-material transport path preferably perpendicularly. It is expedient to provide at least two, preferably four or more slider elements on the slider, so that the sheet material is pushed uniformly on its trailing edge.

To be able to move the sheet material from the sheet-material supply zone to the sheet-material removal zone, it is necessary for the slider or the slider elements of the slider to engage in the sheet-material transport path. Particularly in the case of a rotatably disposed slider this involves the danger that while being supplied to the sheet-material supply zone the sheet material collides with the slider elements moving around the rotation axis. These movements consequently have to be coordinated in such a way that the trailing edge of the supplied sheet material reaches the sheet-material supply zone before the slider element, which is disposed radially inside. However, this has the disadvantage that the spacing between the supplied sheet material has to be sufficiently great so that the slider elements do not collide with subsequent sheet material.

In a preferred embodiment of the deflecting device it is therefore provided that at least one slider element plunges in to the sheet-material transport path only shortly before the sheet-material supply zone is reached and correspondingly emerges again from the sheet-material transport path downstream of the sheet-material removal zone. In a suitable embodiment, it can thus be achieved that the first contact of the slider elements with the sheet material takes place along the complete trailing edge of the sheet material. Simultaneously it is ruled out that the slider collides with subsequent sheet material transported at a smaller distance to the preceding sheet material.

The plunging and emerging of the slider elements into and out of the sheet-material transport path can be realized in different ways. According to a first preferred variant a drive is provided for the slider, serving for actively lowering or lifting the rotatable slider with its slider elements at the suitable time.

A second preferred variant of a substantially simpler construction instead provides an oblique supply section in the transport direction of the sheet material upstream of the sheet-material supply zone, and an oblique removal section in the transport direction of the sheet material downstream of the sheet-material removal zone. By means of the oblique supply and removal sections the level of the sheet-material transport path in the deflecting area of the support plate is adapted to a higher or lower level of the sheet-material transport path in the transport direction upstream and downstream of the deflecting area in such a fashion that the slider elements plunge into the sheet-material transport path of the deflecting area or emerge out of the sheet-material transport path again in the zone of the oblique supply and removal sections.

To ensure a reliable sheet-material transport of the sheet material in particular in the deflecting area of the support plate, preferably a cover plate is provided, defining a gap together with the support plate, in which the sheet-material transport path is disposed. To ensure that in this case the slider elements can protrude into the sheet-material transport path during their movement from the sheet-material supply zone to the sheet-material removal zone, either the support plate and/or the cover plate have corresponding openings for the slider elements. It is even expedient for the slider elements to extend through the sheet-material transport path into or through the respectively other plate, in order to prevent the sheet material from slipping through between the slider elements and one of the two plates.

In the case of the aforementioned second variant with oblique supply- and removal sections these openings extend as far as into the oblique supply- and removal portions.

By means of the deflecting device described above the sheet material can be deflected for example by 90° or more, in particular also by 180°, depending on the orientation of the two transport paths adjoining the deflecting device.

The coordination of the slider movement with the transport speed and the timing of the supplied bank notes can be achieved by means of a separate, correspondingly controlled transport device, which is provided preferably at least in the sheet-material direction upstream of the sheet-material supply zone and possibly also in the sheet-material transport direction downstream of the sheet-material removal zone. Therein for example transport rollers can be used. The support plate and possibly also the cover plate can for this purpose extend as far as into an area upstream of the sheet-material supply zone and downstream of the sheet-material removal zone, wherein the transport rollers extend into the sheet-material transport path through the plates.

BRIEF DESCRIPTION OF THE DRAWINGS

In the following the invention will be explained in more detail by way of example with reference to the accompanying drawings. The figures are described as follows.

DETAILED DESCRIPTION OF VARIOUS EMBODIMENTS

Figure 1:
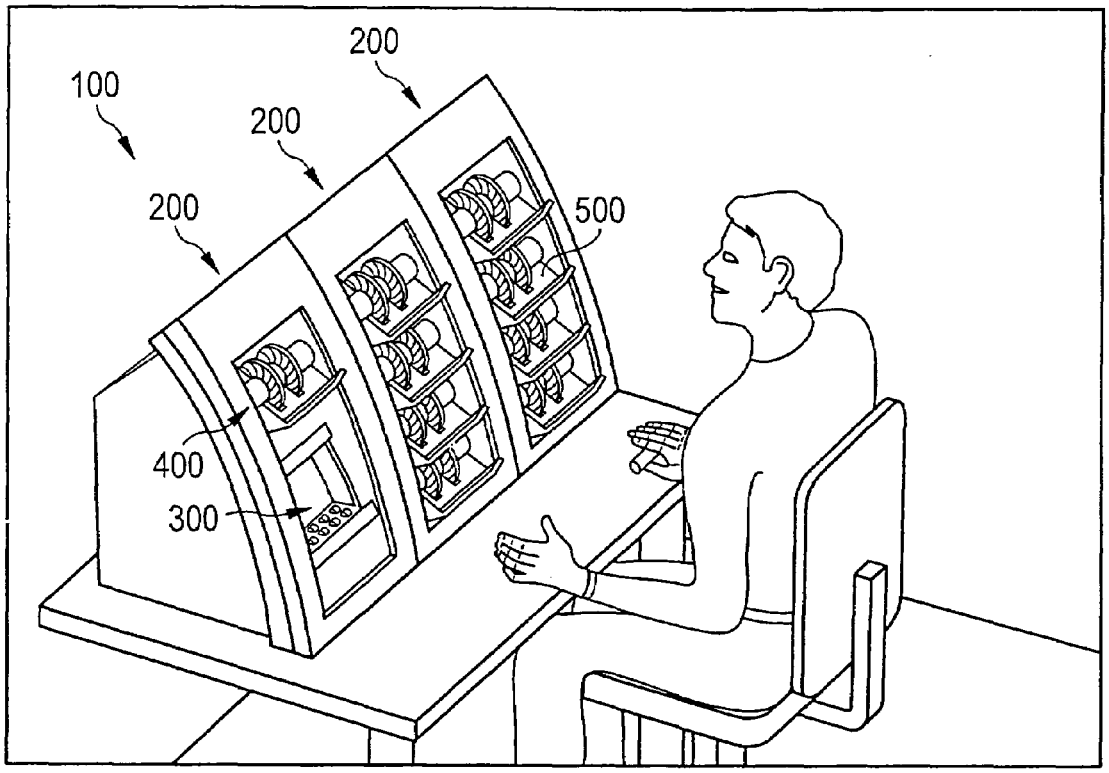
FIG. 1 a bank note processing apparatus in the form of a desktop implementation consisting of several modules, FIG. 2 a top view of an inventive deflecting device, FIG. 3 a lateral view of the deflecting device of FIG. 2, FIG. 4 an enlarged detail of the lateral view according to FIG. 3, FIG. 5*a* to 5*d* the deflecting device of FIGS. 2 to 4 in a perspective view from below, without the support plate.

FIG. 1 shows a bank note processing apparatus 100 as a concrete example for an apparatus for processing sheet-shaped documents of value. The apparatus is built up of several modules and in the shown embodiment consists of three modules 200. The left module comprises a sheet-material singling device 300 with an input pocket, into which the operator can place a stack of bank notes or other documents of value, such as e.g. checks. The bank notes are fed singly into the left module 200 by means of the singling device 300, and are checked and sorted by means of devices for measuring and checking properties of sheet material contained therein. This checking can for example be limited to the denomination of the inserted bank notes. In addition or instead, however, also the quality and/or authenticity features of the bank notes can be checked. Bank notes which do not fulfill certain checking criteria, since e.g. the denomination cannot be determined and/or the result of the authenticity check was negative and/or the fitness for circulation is no longer given, are output as so-called "rejects" in the reject pocket 400 disposed above the singling device 300. The other documents are passed on to a predetermined output pocket 500 correlated to the checking result, so that they can be removed in a correspondingly sorted state from the output pockets 500 by the operator.

In the shown embodiment the two modules 200 on the right only serve for outputting the bank notes. Devices for measuring and checking the bank notes do not necessarily have to, but can be included here. All output pockets 400, 500 are implemented as spiral slot stackers in the shown embodiment.

In the bank note processing apparatus 100 the bank notes are input, processed and output in horizontal format. For transporting the bank notes from one module 200 to the next module 200 a deflecting device can be used advantageously, such as described in the following with reference to FIG. 2 to 5. Such a deflecting device can for example be provided in the area of the back side of a module 200 in a vertical orientation in such a fashion that the bank notes BN transported in horizontal format are supplied to the deflecting device vertically from above and are passed on in a removal direction of 90° thereto, while maintaining the transverse orientation. Such an arrangement is particularly space-saving. In the subsequent module 200 the bank note can then, if required, again be deflected by 90° by means of the deflecting device.

Figure 2:
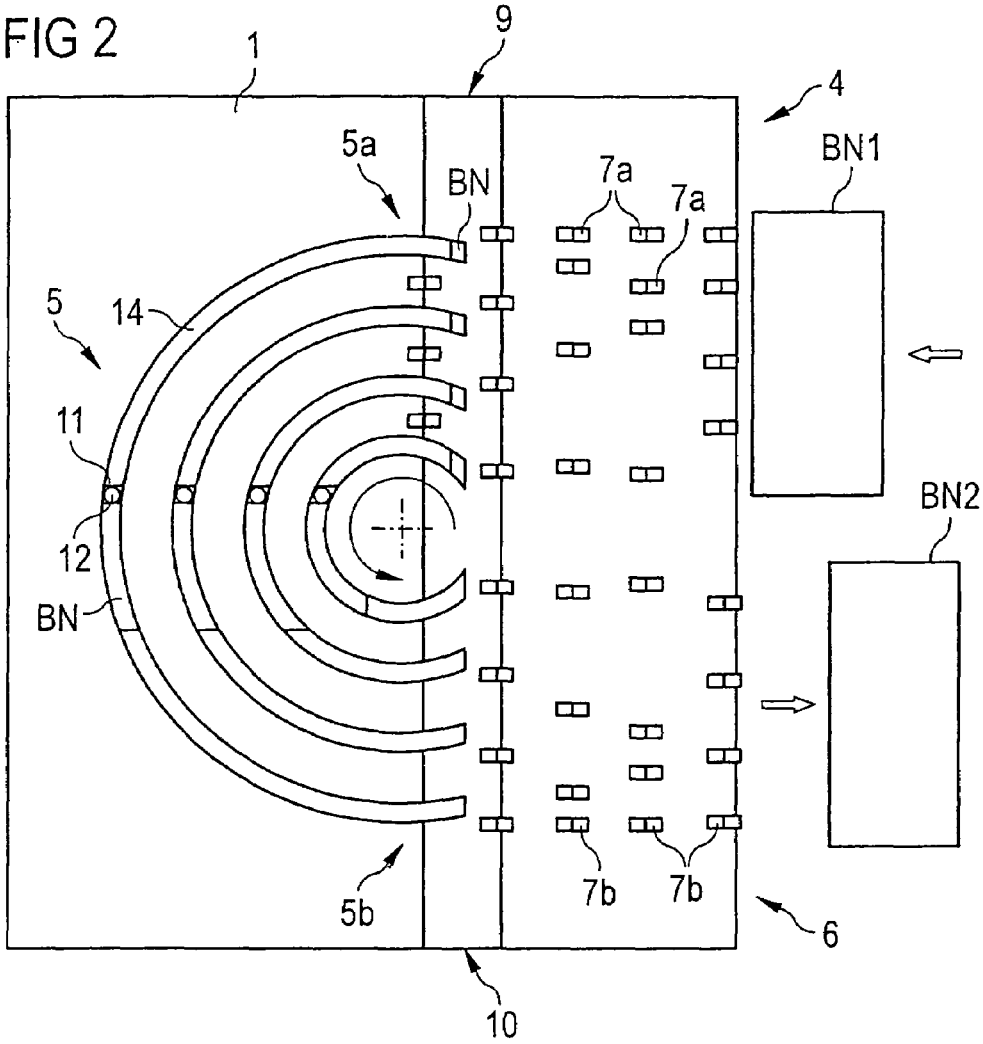
Figure 3:
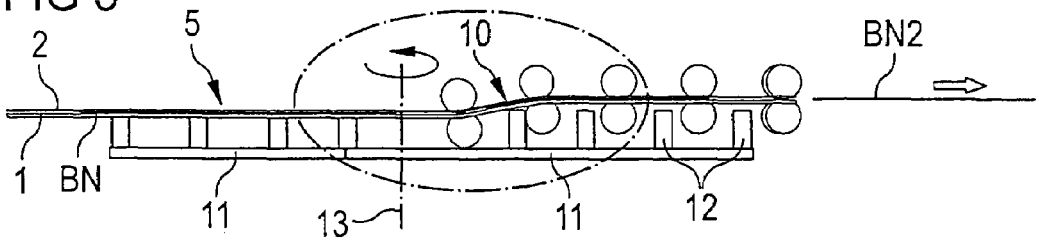
Figure 4:
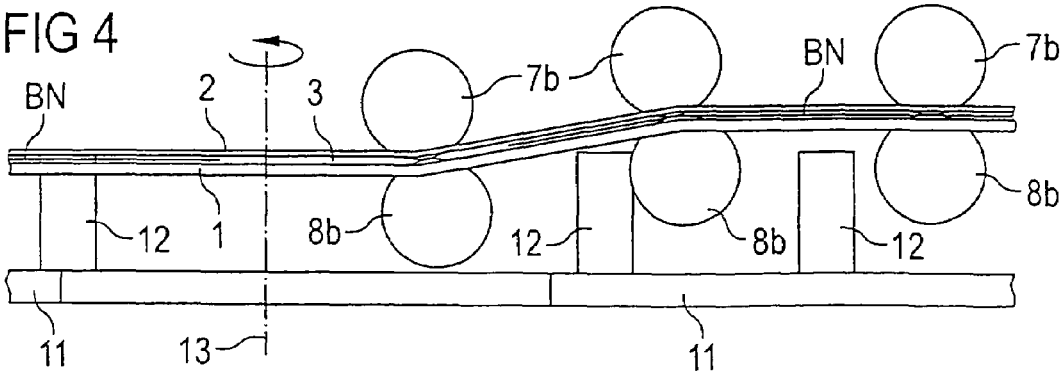

FIG. 2 shows a deflecting device for deflecting bank notes BN by 180° while maintaining the orientation of the sheet material relative to the transport direction. Bank notes BN are supplied in the direction of the arrow to the deflecting device from a first transport path and are passed on in the direction of the arrow to a second transport path downstream thereof. In FIG. 3 the deflecting device is shown in a lateral view, and in FIG. 4 a detail of the lateral view is represented in an enlarged fashion, to show details more clearly.

The deflecting device comprises a support plate 1 and a cover plate 2 defining a gap 3 disposed in between, in which the bank notes BN are transported. The transport path for the bank notes BN defined thereby comprises two steps and three areas. In a supply area 4 a transport device is integrated that is formed by a number of transport rollers 7*a*, 7*b*, which protrude through the plates 1, 2 into the gap 3 from the top and from below, in order to collect sheet material supplied by the first transport path and to coordinate the further transport in regard of transport speed and timing/frequency. For this purpose the transport rollers 7*a* and/or 8*a* are driven correspondingly.

A second zone 5 is disposed slightly higher than the supply area 4 and represents the zone of the deflecting device in which the bank notes BN are deflected by the desired angle. The third zone adjoining the deflecting area 5 is the removal area 6, which is disposed on the same level again as the supply area 4 and which again comprises a transport device in the form of transport rollers 7*b*, 8*b*, to pass on the bank notes BN deflected in the deflecting area 5 to a second, downstream transport path. Also these transport rollers 7*b*, 8*b* are at least partially driven in a suitable manner for this purpose.

Between the supply area 4 and the deflecting area 5, as well as the deflecting area 5 and the removal area 6, the plates 1, 2 are designed obliquely to overcome the difference in level between the respective zones 4, 5 or 5, 6, forming the oblique supply section 9 or the oblique removal section 10. The supplied bank note BN 1 is thus supplied from the supply area 4 by means of the rollers 7*a*, 8*a* via the oblique supply section 9 to the deflecting area 5 disposed on a different level, are deflected by 180° there, as will be described below in detail, and are removed via the oblique removal section 10 to the removal area disposed on the first level, and passed on from there by means of the transport rollers 7*b*, 8*b* to the downstream transport path. Correspondingly the deflecting area 5 has a sheet-material supply zone 5*a* and a sheet-material removal zone 5*b*, which are directly adjoined by the oblique supply section 9 or the oblique removal section 10.

A slider 11 with fingerlike slider elements 12 is disposed rotatably around a rotation axis 13 disposed perpendicularly to the deflecting area 5. The fingerlike finger elements 12 extend parallel to the rotation axis 13. Circular openings 14 are provided both in the support plate 1 and in the cover plate 2 in the deflecting area 5 for the slider elements 12 extending perpendicularly from the slider 11, and extend as far as into the oblique supply section 9 and the oblique removal section 10. With the support plate 1 and the cover plate 2 the slider elements 12 consequently comb substantially only the deflecting area 5, so that they engage on bank notes BN to be deflected in this area and can displace them by turning the slider 11 around the rotation axis 13, but cannot collide with the bank notes BN1, BN2 disposed in the supply area 4 and the removal area 6. Correspondingly the bank notes to be deflected BN can be engaged on their trailing edge by turning the slider 11 once the respective bank note BN has been supplied to the deflecting area 5 to such an extent that also its trailing edge has reached the sheet-material supply zone. The slider elements 12 of the slider 11 then substantially simultaneously engage on the trailing edge.

FIG. 2 to 5 show two sliders 11 commonly disposed rotatably around the rotation axis 11, 13 and oriented symmetrically in relation to each other. Each slider has four slider elements 12. It is also possible to provide e.g. three or four sliders or, where required, only one slider. Equally, more or fewer slider elements 12 can be provided.

Furthermore the deflecting device according to FIG. 2 to 5 is provided for deflecting the sheet material by 180°. However, any required deflection angles are possible, in particular in the range of 0° to 180°. The device is particularly suitable for deflecting the sheet material by 90°, if for example the deflecting area 5 is chosen to be only half as large, with openings 14 describing only a quarter circle instead of a half circle. The supply area 4 and the removal area 6, as well as the oblique supply section 9 and the oblique removal section 10, are then arranged in the corresponding place in relation to the sheet-material supply zone 5*a* and the sheet-material removal zone 5*b* of the deflecting area 5 reduced in dimension.

In FIG. 2 to 5 the sliders 11 are disposed below the support plate 1 and the cover plate 2, thus engage in the deflecting area 5 from below. The overall arrangement can also be used upside down, so that the support plate 1 takes over the function of the cover plate 2 and the cover plate 2 takes over the function of the support plate 1, and the sliders correspondingly engage in the gap 3 formed between the plates from above. Also an inclined or vertical arrangement of the deflecting device e.g. in a bank note processing apparatus is conceivable. In the case of a vertical arrangement it is in principle impossible to distinguish between support plate 1 and cover plate 2, since both plates also serve at least as a plate for resting the sheet material.

Furthermore in the deflecting area 5 of the support plate a not shown guide element can be provided along an outer edge of the sheet-material transport path to prevent the sheet material BN from sliding away to the side due to centrifugal forces during deflection. An additional possibility is to adjust the friction force acting on the sheet material BN in such a fashion that the centrifugal force effect cannot materialize. This is e.g. fulfilled if the sum of the friction forces between the slider elements 12 and the edge of the sheet material is greater than the centrifugal force. A concrete embodiment can e.g. consist in the slider elements 12 having a coating that increases the friction force. This can for example be realized by providing a surface of the slider elements 12 engaging on the bank note BN with a substantially softer material than the material of the sheet material, such as e.g. with an elastomer or rubber, etc., or with a sharp-edged, granular material that is substantially harder than the material of the sheet material, such as e.g. with diamond grain or aluminum oxide grain, etc.

With reference to FIG. 5*a* to 5*d* in the following the deflecting process is explained in detail. Therein FIG. 5*a* to 5*d* show the deflecting device of FIG. 2 to 4 in a perspective view from below, but without the support plate 1, so that the respective position of the bank notes BN is more readily recognizable. The position shown in FIG. 5*c* corresponds to the position of the deflecting device shown in FIG. 2 in plan view.

Figure 5A:
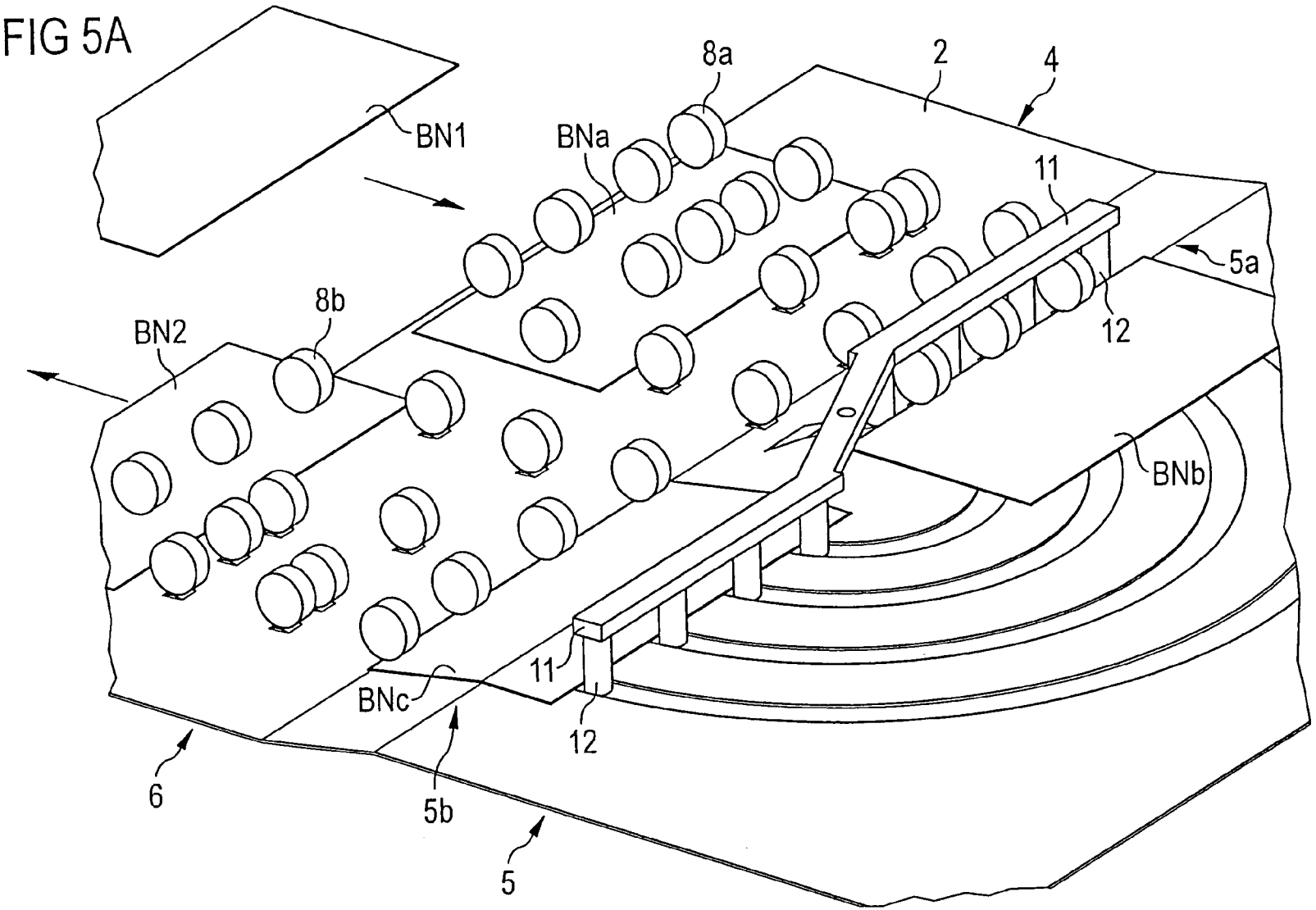

FIG. 5*a* shows the deflecting device at a moment in which the subsequent bank note BN 1 supplied by a not shown transport path has not yet reached the device and a bank note BN 2 to be forwarded to a not shown second transport path has not yet left the device completely. In the deflecting device itself there are three bank notes BN, referred to as BN a, BN b and BN in the following. At the time shown in FIG. 5*a* the bank note BN b has reached the sheet-material supply zone 5*a* substantially completely and the greater part of the bank note BN c already deflected by 180° has already left the sheet-material removal zone. This is the time at which the deflecting process starts for the bank note BN b and is concluded for the bank note BN c. The slider elements 12 of the two sliders 11 engaging on the respectively trailing edge of the bank notes BN b, BN c are correspondingly disposed respectively on one line transverse to the transport direction. Approximately at this time the supply rollers 8*a* next to the deflecting area 5 loose contact with the bank note BN b to be deflected, so that the bank note BN b is displaced in the deflecting area 5 only by means of the slider 11. At the same time the removal rollers 7*b*, 8*b* grip the leading edge of the already deflected bank note BN c in a corresponding manner, so that a uniform further transport of the bank note in the removal direction is ensured. The transport speed of the removal rollers 7*b*, 8*b* in the removal area 6 corresponds to the transport speed of the bank notes in the deflecting area 5, so that after the deflected bank note BN c was passed on from the slider 11 to the removal rollers 8*b*, any further contact of the slider 11, which keeps rotating, with the bank note BN c is ruled out.

Figure 5B:
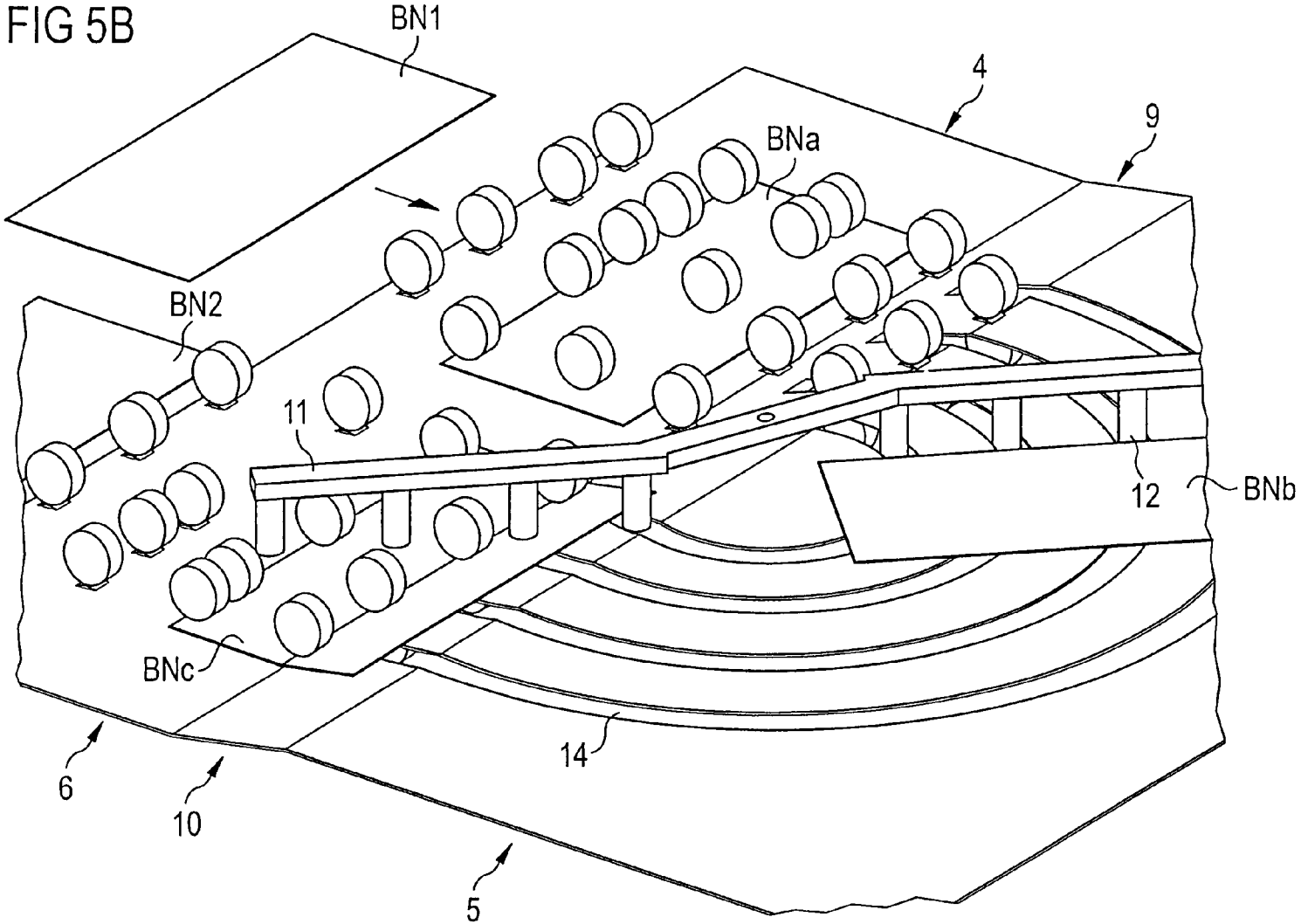

FIG. 5*b* shows the deflection device with sliders 11 rotated by 45° in comparison to FIG. 5*a*. Correspondingly, the bank note BN b has already been deflected by 45° at this time. The already deflected bank note BN c has left the deflecting area 5 completely and is disposed in the removal area 6. The bank note BN a still to be deflected is still disposed in the supply area 4. The openings 14 for the slider elements 12 extending as far as into the oblique supply section 9 or the oblique removal section 10 are clearly visible here, as is the fact that the inner slider element 12 of the slider 11 rotating after the deflected bank note BN c is still disposed in such an opening 14, while the three outer slider elements 12 have already left the corresponding openings 14 and are suspended above the bank note BN c in the removal area 6.

Figure 5C:
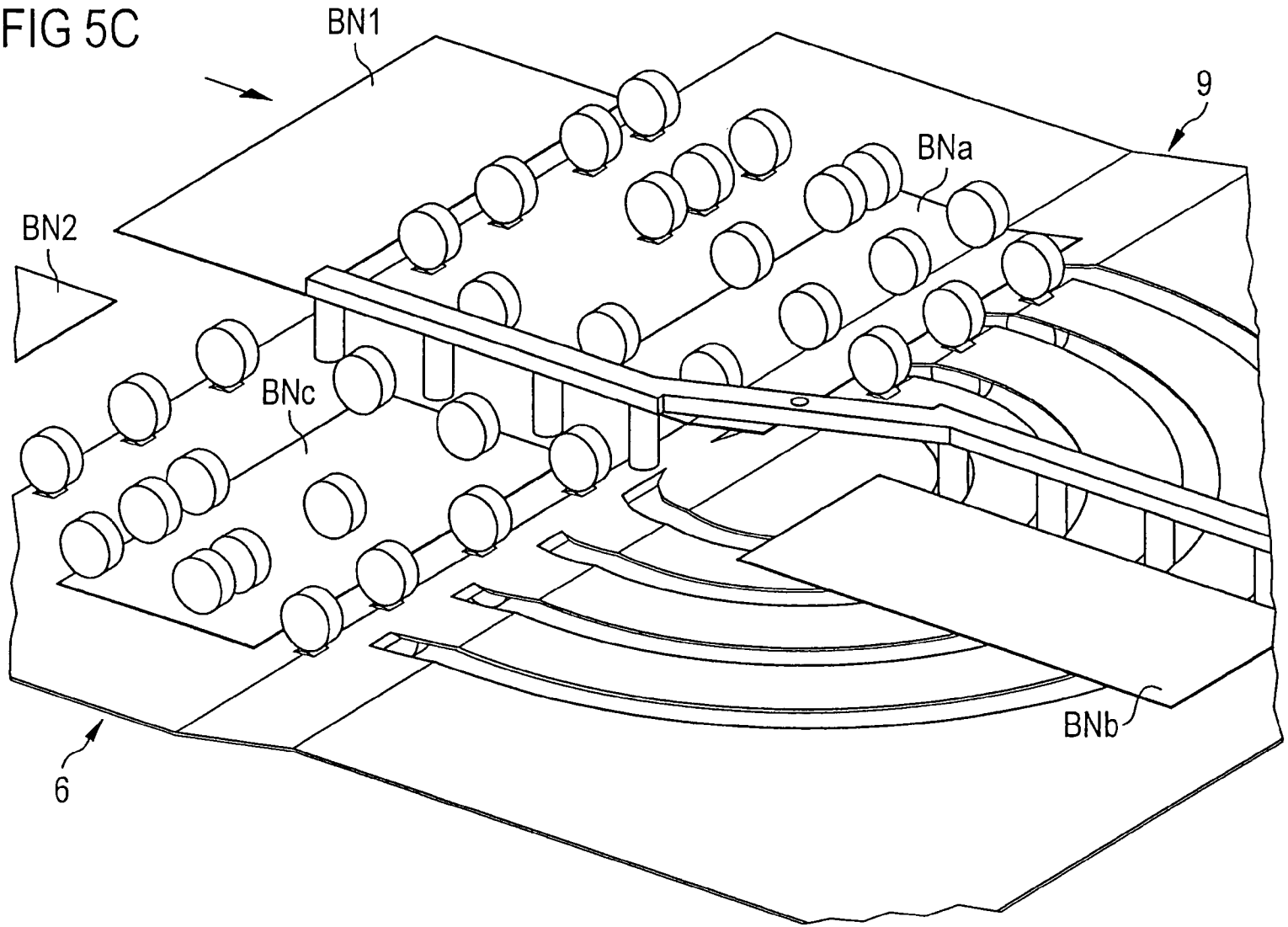

FIG. 5*c* shows the deflecting device at a time when the bank note BN b has already been deflected by 90°. The bank note BN a still to be deflected has reached the oblique supply section 9 and the already deflected bank note BN c is disposed entirely in the removal area 6 at this time.

Figure 5D:
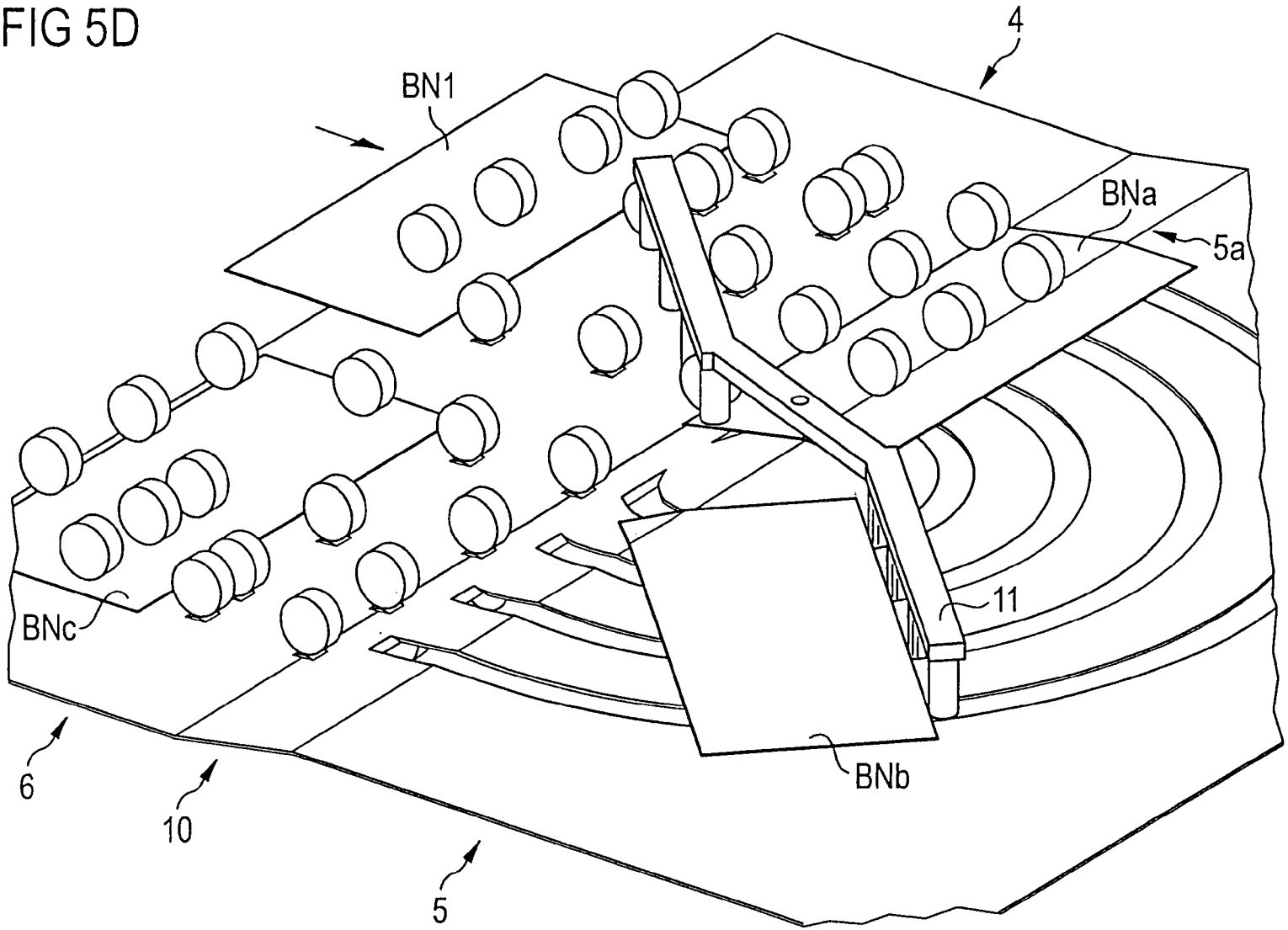

FIG. 5*d* shows the deflecting device with sliders 11 advanced again by 45°. The bank note BN b disposed in the deflecting area 5 has at this time already reached the oblique removal section 10, whereas a part of the bank note BN a still to be deflected has reached the sheet-material supply zone 5*a*, and is thus not yet engaged by the slider 11. The already deflected bank note BN c is still disposed in the removal area 6 in its entirety, if in an advanced position. The subsequent bank note BN 1 to be deflected already enters the supply area 4.

When the slider 11 is turned again by another 45° a situation described with reference to FIG. 5*a* is given again.

The invention claimed is:

1. Apparatus for deflecting flat, rectangular sheet material from a first sheet material transport path having a first transport direction to a second sheet material transport path having a second transport direction differing from the first transport direction, comprising a support plate defining a sheet material transport path for the sheet material to be deflected, having a deflecting area comprising a sheet material supply zone facing the first transport path and a sheet material removal zone facing the second transport path, wherein the sheet material supply zone and the sheet material removal zone are co-planar, and at least one slider arranged to engage a trailing edge of the sheet material supplied to the sheet material supply zone, wherein the at least one slider is arranged such that upon movement of the at least one slider, the sheet material engaged by the slider in the sheet material supply zone is pushed along the transport path from the sheet material supply zone to the sheet material removal zone, while the orientation of the sheet material relative to the pushing direction is maintained;

the apparatus further including a cover plate, and a gap being defined between the cover plate and the support plate, the sheet material transport path being disposed in the gap.

2. Apparatus according to claim 1, wherein the at least one slider is arranged to be rotated.

3. Apparatus according to claim 2, wherein the at least one slider is adapted to being moved back to the sheet material supply zone after reaching the sheet material removal zone, while maintaining a direction of rotation.

4. Apparatus according to claim 1, wherein at least two of the sliders are provided, said sliders arranged symmetrically in relation to a slider movement center.

5. Apparatus according to claim 1, wherein the at least one slider is arranged to plunge into the sheet material transport path in the movement direction of the slider upstream of the sheet material supply zone, and emerge again from the sheet material transport path downstream of the sheet material removal zone.

6. Apparatus according to claim 5, including a drive for the at least one slider arranged to actively plunge the slider into the sheet material transport path and to cause its emergence therefrom.

7. Apparatus according to claim 1, wherein the at least one slider comprises at least one slider element and either or both the support plate and the cover plate has one or several openings in the deflecting area, through which openings the at least one slider element protrudes at least as far as into the sheet material transport path when the slider is moved from the sheet material supply zone to the sheet material removal zone.

8. Apparatus according to claim 7, wherein upon the slider being moved from the sheet material supply zone to the sheet material removal zone the at least one slider element protrudes through the support plate or the cover plate and the sheet material transport path, as far as into or through the correspondingly other of the support plate and cover plate.

9. Apparatus according to claim 7, wherein the at least one slider element is arranged as a finger.

10. Apparatus according to claim 9, wherein at least 2 slider elements are provided on the at least one slider.

11. Apparatus according to claim 1, wherein the first and the second transport direction are oriented at an angle of 90° or more in relation to each other.

12. Apparatus according to claim 11, wherein the first and the second transport direction are oriented at an angle of 180° in relation to each other.

13. Apparatus according to claim 1, including either or both a first transport device coordinated with the movement of the slider, said first transport device being disposed upstream of the sheet material supply zone in the sheet material transport direction, and a second transport device coordinated with the movement of the slider, said second transport device disposed downstream of the sheet material removal zone in the sheet material transport direction.

14. Apparatus according to claim 13, wherein at least one of the first and second transport devices comprises transport rollers.

15. Apparatus according to claim 13, wherein the support plate extends into the area of at least one of the first and second transport devices.

16. Apparatus according to claim 1, including a guide element along an outer edge of the sheet material transport path in the deflecting area.

17. Apparatus according to claim 1, wherein the slider has a coating increasing the friction force acting on the sheet material.

18. Apparatus according to claim 17, wherein a surface of the slider engaging the sheet material is provided with either or both a softer and a harder material than the material of the sheet material.

19. Apparatus for processing sheet-shaped documents of value, comprising a first sheet material transport path and a second sheet material transport path, and an apparatus for deflecting sheet material arranged to deflect sheet material from the first to the second sheet material transport path, the apparatus comprising:

a support plate defining a sheet material transport path for the sheet material to be deflected, having an even deflecting area comprising a sheet material supply zone facing the first transport path and a sheet material removal zone facing the second transport path, and at least one slider arranged to engage a trailing edge of the sheet material supplied to the sheet material supply zone, wherein the at least one slider is arranged such that upon movement of the at least one slider, the sheet material engaged by the slider in the sheet material supply zone is pushed along the transport path from the sheet material supply zone to the sheet material removal zone, while the orientation of the sheet material relative to the pushing direction is maintained;

the apparatus further including a cover plate, and a gap being defined between the cover plate and the support plate, the sheet material transport path being disposed in the gap;

wherein the sheet material supply zone and the sheet material removal zone are co-planar.

20. Apparatus according to claim 19, including one or several devices arranged to measure and check features of the sheet material, and at least one sheet material input pocket with a sheet material singling device and at least one sheet material output pocket.

21. Apparatus according to claim 19, including several apparatus modules, wherein the deflecting device is provided between the first and the second sheet material transport path at a delivery point at which sheet material is transported from one apparatus module to another apparatus module.

22. Apparatus for deflecting flat, rectangular sheet material from a first sheet material transport path having a first transport direction to a second sheet material transport path having a second transport direction differing from the first transport direction, comprising a support plate defining a sheet material transport path for the sheet material to be deflected, having a deflecting area comprising a sheet material supply zone facing the first transport path and a sheet material removal zone facing the second transport path, and at least one slider arranged to engage a trailing edge of the sheet material supplied to the sheet material supply zone, wherein the at least one slider is arranged such that upon movement of the at least one slider, the sheet material engaged by the slider in the sheet material supply zone is pushed along the transport path from the sheet material supply zone to the sheet material removal zone, while the orientation of the sheet material relative to the pushing direction is maintained;

wherein the at least one slider is arranged to plunge into the sheet material transport path in the movement direction of the slider upstream of the sheet material supply zone, and emerges again from the sheet material transport path downstream of the sheet material removal zone;

the apparatus further including an oblique supply section in the sheet material transport path upstream of the supply area, and an oblique removal section in the sheet material transport path downstream of the sheet material removal zone, the arrangement of the oblique supply section and oblique removal section causing adjustment of the level of the sheet material transport path in the deflecting area to a level of the sheet material transport path in the transport direction upstream and downstream of the deflecting area, enabling the at least one slider to be plunged into the sheet material transport path in the area of the oblique supply section and to emerge again from the sheet material transport path in the area of the oblique removal section.

23. Apparatus according to claim 22, wherein the at least one slider comprises at least one slider element and either or both the support plate and the cover plate has one or several openings in the deflecting area, through which openings the at least one slider element protrudes at least as far as into the sheet material transport path when the slider is moved from the sheet material supply zone to the sheet material removal zone; and wherein the openings extend as far as into the oblique supply section and oblique removal section.

* * * * *